US011506219B2

(12) United States Patent
Houle

(10) Patent No.: US 11,506,219 B2
(45) Date of Patent: Nov. 22, 2022

(54) BLOWER IMPELLER

(71) Applicant: IMMEUBLES MFP 1006 INC., Wickham (CA)

(72) Inventor: Mario Houle, Wickham (CA)

(73) Assignee: IMMEUBLES MFP 1006 INC., Wickam (CA)

( * ) Notice: Subject to any disclaimer, the term of this patent is extended or adjusted under 35 U.S.C. 154(b) by 0 days.

(21) Appl. No.: 17/325,614

(22) Filed: May 20, 2021

(65) Prior Publication Data

US 2021/0364008 A1 Nov. 25, 2021

Related U.S. Application Data

(60) Provisional application No. 63/029,020, filed on May 22, 2020.

(51) Int. Cl.
*F04D 29/30* (2006.01)
*F04D 29/28* (2006.01)
*F04D 3/00* (2006.01)

(52) U.S. Cl.
CPC ..... *F04D 29/281* (2013.01)

(58) Field of Classification Search
CPC ..... F04D 29/181; F04D 29/30; F04D 29/325; F04D 29/544; F04D 3/00; F04D 29/281; F04D 29/324; F04D 29/164; F04D 29/2216; F04D 29/38
See application file for complete search history.

(56) References Cited

U.S. PATENT DOCUMENTS 7,121,793 B2 * 10/2006 Correia ..... F01D 25/246 415/191
7,607,287 B2 * 10/2009 Reba ..... F04D 29/681 416/232
7,621,718 B1 * 11/2009 Liang ..... F01D 25/12 415/115
2013/0004320 A1 * 1/2013 Perret ..... F01D 9/041 416/223 R
2014/0010632 A1 * 1/2014 Spangler ..... F01D 9/065 415/115
2014/0140832 A1 * 5/2014 Hasting ..... F01D 25/246 415/190
2014/0356188 A1 * 12/2014 Kollati ..... F01D 5/186 416/235
2016/0017724 A1 * 1/2016 Xu ..... B22F 10/20 164/28
2016/0024931 A1 * 1/2016 Hiernaux ..... F01D 9/041 416/227 R
2016/0024932 A1 * 1/2016 Hiernaux ..... F04D 29/544 416/227 R
2016/0024933 A1 * 1/2016 Hiernaux ..... F04D 29/544 416/189
2016/0177734 A1 * 6/2016 Quach ..... F01D 5/186 416/97 R
2017/0284417 A1 * 10/2017 Zaccardi ..... F01D 9/065

* cited by examiner

*Primary Examiner* — Long T Tran
(74) *Attorney, Agent, or Firm* — Benoit & Cote Inc.; Mathieu Audet

(57) ABSTRACT

Embodiments of the invention provide a blowing apparatus comprising a body including an impeller equipped with vanes including an opening therein to allow air to pass through the vane when the impeller is rotating.

20 Claims, 13 Drawing Sheets

BLOWER IMPELLER

CROSS-REFERENCES

The present application is a nonprovisional of, and claims priority under 35 U.S.C. 119(e) to, U.S. provisional patent application No. 63/029,020 filed May 22, 2020, entitled BLOWER IMPELLER, which is incorporated herein by reference in its entirety. Any publication of and any patent issuing from the foregoing U.S. patent application is hereby incorporated herein by reference.

BACKGROUND OF THE INVENTION

1. Field of the Invention

This invention generally relates to a blower apparatus for propelling air. The present invention more specifically relates to an impeller for a blower apparatus.

2. Description of the Related Art

Leaves and dirt can be removed with air propelled at a high velocity. A blower apparatus is used to accelerate air and propel air with sufficient velocity to push away leaves and dirt away. Blower apparatuses are coming in various sizes and configurations, from portable blowers to industrial blower apparatuses. Large blower apparatuses are generally connected to a vehicle and powered by the vehicle's engine or a separate power unit. Larger industrial blowers are generally connected to a vehicle and powered by the vehicle's engine or a separate power unit with the vehicle's drive output. In a case of a tractor, the power take off (PTO) is used to connect the drive of the blower apparatus.

A rotatable impeller is operatively secured in the blower apparatus and rotated upon rotation of the blower apparatus drive. The rotatable impeller is generally using the centrifugal force to aspire and propel the air inside a corresponding manifold. The shape, size, weight and rotational speed of the impeller is significantly important to optimize the blowing efficiency of the blower apparatus.

It is desirable to provide an improved impeller over the existing art. It is equally desirable to provide a light weight impeller in order to reduce the amount of force required for rotating the impeller.

It is desirable to provide an impeller including a design adapted to optimize the air flow and augment the blowing efficiency of the blower apparatus without requiring additional power.

Other deficiencies will become apparent to one skilled in the art to which the invention pertains in view of the following summary and detailed description with its appended figures.

SUMMARY OF THE INVENTION

One aspect of the present invention is to alleviate one or more of the shortcomings of the background art by addressing one or more of the existing needs in the art.

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The invention is generally described, in accordance with embodiments thereof, as an improved impeller configuration for a blower apparatus improving the efficiency of the blower. The efficiency of the blower can be increased using a light and strong material for the vanes' impeller, which is going to reduce the inertia moment of the impeller. As an example, a plastic or composite vane can be used instead of a metallic vane to reduce weight of the vanes. The plastic panel can be laminated with layers of aluminum, or other suitable material, to further improve the vane's resistance and the stiffness of the vanes. The laminated structure of the vanes can also protect the vanes against erosion and contact with solid particles when in operation.

Aspects of our work provides, in accordance with at least one embodiment thereof, a vane of a blower impeller that includes at least one opening therein for letting some air to move through the vane.

Aspects of our work provides, in accordance with at least one embodiment thereof, a vane of a blower impeller that includes a plastic core covered or laminated with a layer of metallic material on each surface.

Other aspects of our work provides, in accordance with at least one embodiment thereof, a blower impeller that includes a plurality of radial vanes, opposed and parallel radial vanes being not coplanar in respect to each other.

Other aspects of our work provides, in accordance with at least one embodiment thereof, a vane with a tapered shape in the direction of the impeller axis.

Another aspect of our work provides, in accordance with at least one embodiment thereof, an opening in the vane that is generally located within a portion of the vane that is laterally bordered by non-parallel axial edges.

Another aspect of our work provides, in accordance with at least one embodiment thereof, an opening in the vane that is generally within an axial region of openings in a blower housing, the openings allowing air to move through the blower housing to be propelled by the blower impeller.

Additional and/or alternative features, aspects, and advantages of embodiments of the present invention will become apparent from the following description, the accompanying drawings, and the appended claims.

DESCRIPTION OF EMBODIMENT(S) OF THE INVENTION

Figure 1:
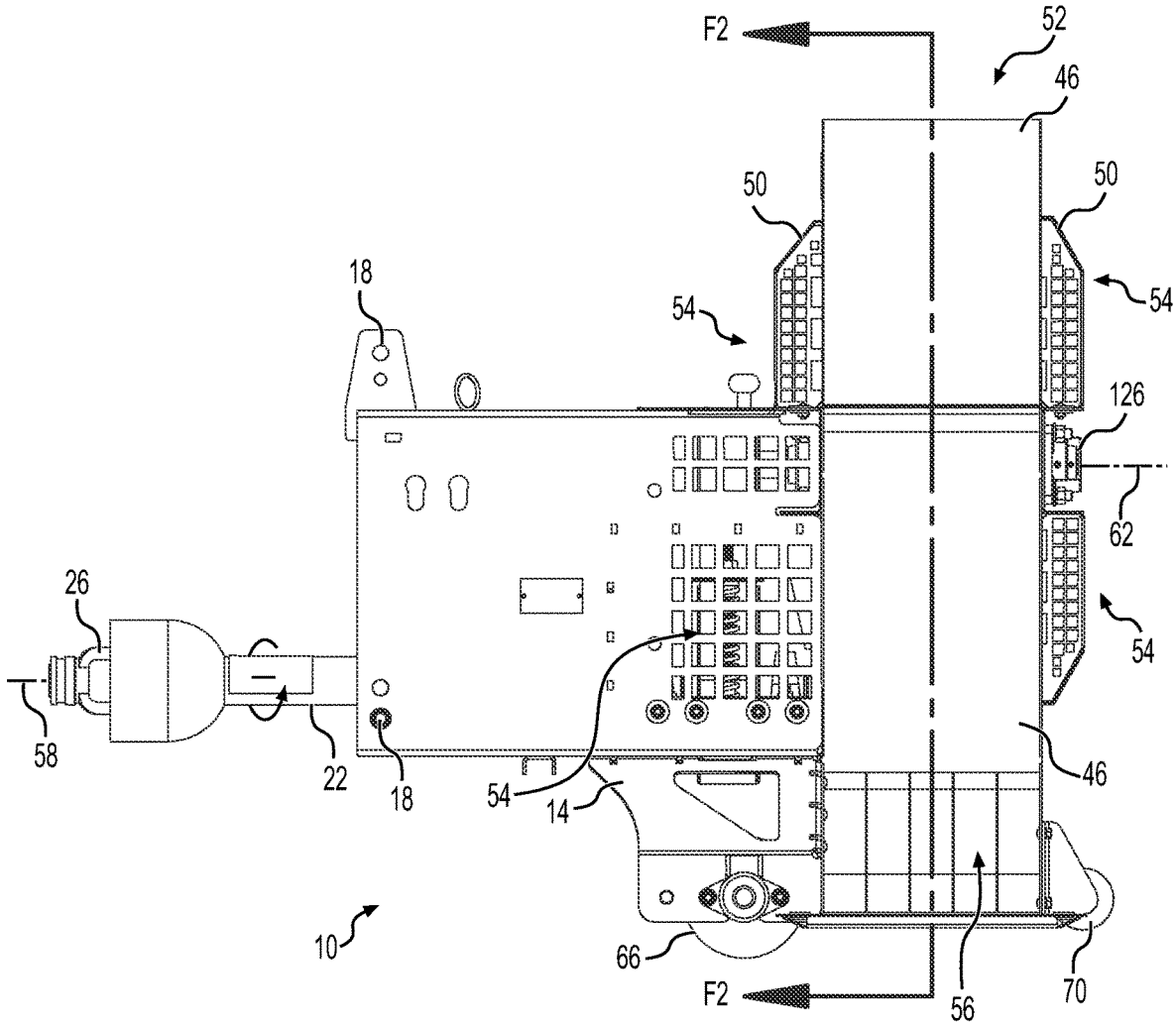
FIG. 1 is a left side elevation view of an exemplary blower apparatus, in accordance with at least one embodiment thereof.

Our work is now described with reference to the figures. In the following description, for purposes of explanation, numerous specific details are set forth in order to provide a thorough understanding of the present invention by way of embodiment(s). It may be evident, however, that the present invention may be practiced without these specific details.

As a preliminary matter, it will be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention discloses herein; only one or a plurality of the features disclosed herein; or combination thereof. As such, many embodiments are implicitly disclosing herein and fall within the scope of what is regarded as the invention.

Accordingly, while the invention is described herein in detail in relation to one or more embodiments, it is to be understood that this disclosure is illustrative and exemplary of the invention and is made merely for purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. II is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention is to be defined by the issued claim(s) rather than the description set forth herein.

Additionally, it is important to note that each term used herein to that which the Ordinary Artisan would understand such term to mean bases on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory Provision is intended to and should apply in the interpretation of such claim element with regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers." "a picnic basket having crackers without cheese", and "a picnic basket having both cheese and crackers." When used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese.".

Referring the drawings, one or more preferred embodiments of the invention are next described. The following description of one or more preferred embodiments is merely exemplary in nature and is in no way intended to limit the invention, its implementations, or uses. Hence, a novel blower apparatus will be described herein after.

Figure 5:
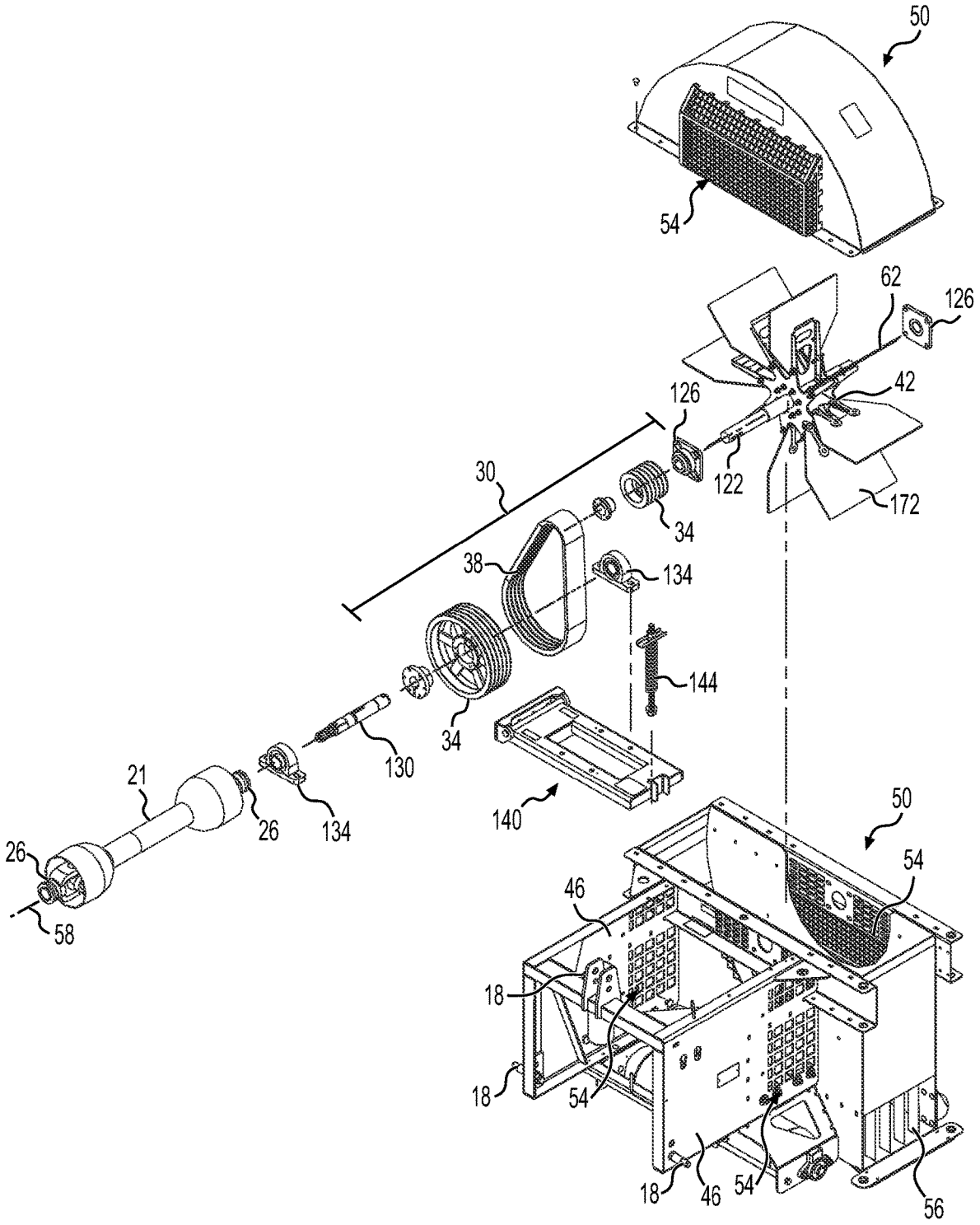
FIG. 5 is a front-left exploded perspective view of the exemplary blower apparatus of FIG. 1, in accordance with at least one embodiment thereof.

A blower apparatus 10 is illustrated in FIG. 1 throughout FIG. 5 in one of possible embodiments thereof. The blower apparatus 10 is including a frame 14 adapted to be secured to a vehicle, not shown, with drive unit via a plurality of connection points 18. The drive unit (not shown in the figures) can be a tractor equipped with a power take off (PTO) connected to the drive member 22 of the blower apparatus 10. Other drive units like a dedicated internal combustion engine or an electric motor could be alternatively used without departing from the scope of the present application. For instance, the PTO of a tractor is adapted to be operatively connected to the drive member 22, which is generally including a pair of universal joints 26, to rotate a ratio-altering mechanism 30 for increasing the rotation speed of the impeller 42. The ratio-altering mechanism 30 is represented with a set of interacting pulleys 34 and belts 38 assembly in the illustrated embodiment. Alternatively, the ratio-altering mechanism 30 could be embodied as a gearbox or other mechanisms allowing a modification of the rotation speed between the drive member and the impeller 42. The frame 14 is covered with protective side cover portions 46 on lateral sides thereof while a rear cover 50 is surrounding and protecting the impeller 42 forming an impeller housing 52 that will be discussed in further details below. The side cover portion 46 is including a series of openings 54 therein for allowing air to be aspirated with the vacuum created by the rotation of the impeller 42. Similarly, the rear cover 50 includes a series of openings 54 also for allowing air to be vacuumed by the impeller 42 and propelled with velocity through the outlet 56. It can be appreciated that the series of openings 54 are disposed around the impeller axis 62 to let air aspired by the centrifugal effect of the rotating impeller 42 in a volute 90. The location of the series of openings 54 are generally disposed toward a center of the impeller 42 to allow air to engage in the rotating impeller 42 and prevent air rotating with the impeller 42 to get outside the volute 90 with the higher air pressure about the radial and distal portion of the rotating impeller 42 in the volute 90. As it will be detailed below, in accordance with embodiments thereof, the series of openings 54 are generally axially aligned with openings 188 in vanes 172 of the impeller 42.

The blower drive 26 is rotating about a drive axis 58 while the impeller is rotating about an impeller axis 62, the blower drive 26 and the drive axis 58 are not concentric to each other. The blower drive 26 and the drive axis 58 are however parallel to each other in the illustrated embodiment, given the intervening distance required therebetween by the ratio-altering mechanism 30. Additionally, a front roller 66 is rotatably disposed in front of the blower apparatus 10 for supporting the blower apparatus 10 over the ground at a predetermined height and another rear roller 70 is disposed to the rear of the blower apparatus 10 for additional support.

Figure 2:
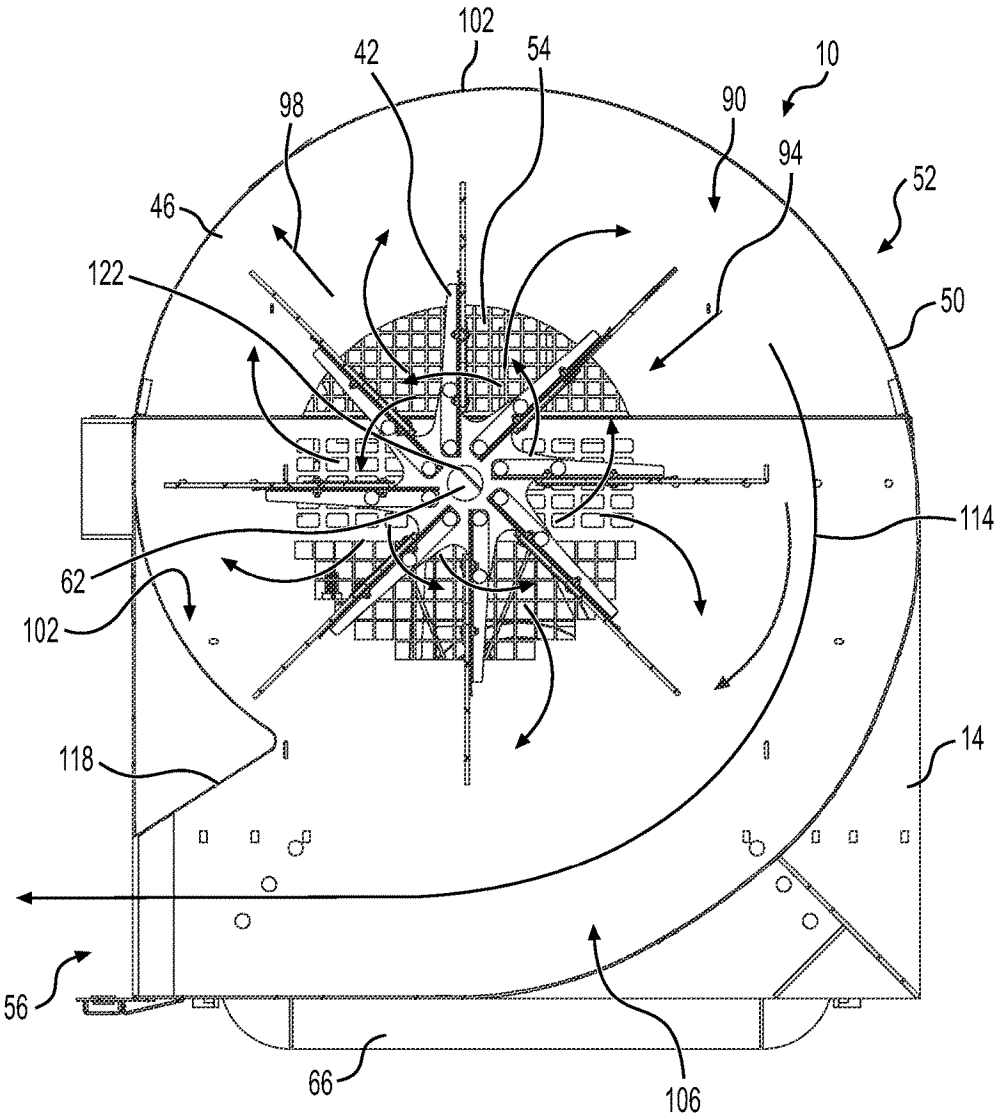
FIG. 2 is a rear side elevation view of the exemplary blower apparatus of FIG. 1, in accordance with at least one embodiment thereof.
Figure 3:
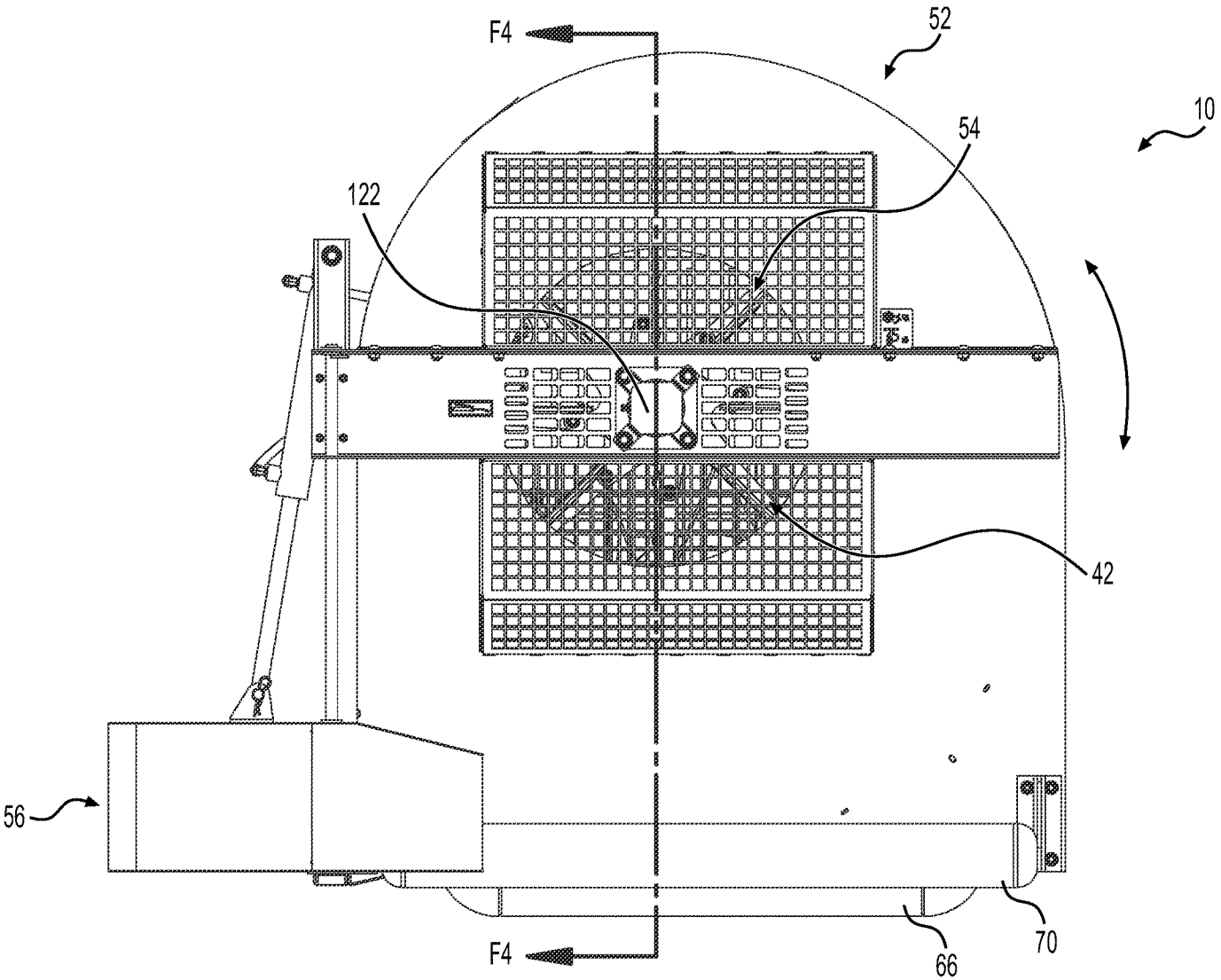
FIG. 3 is a rear side elevation view of the exemplary blower apparatus of the exemplary snowblower of FIG. 1, in accordance with at least one embodiment thereof.
Figure 4:
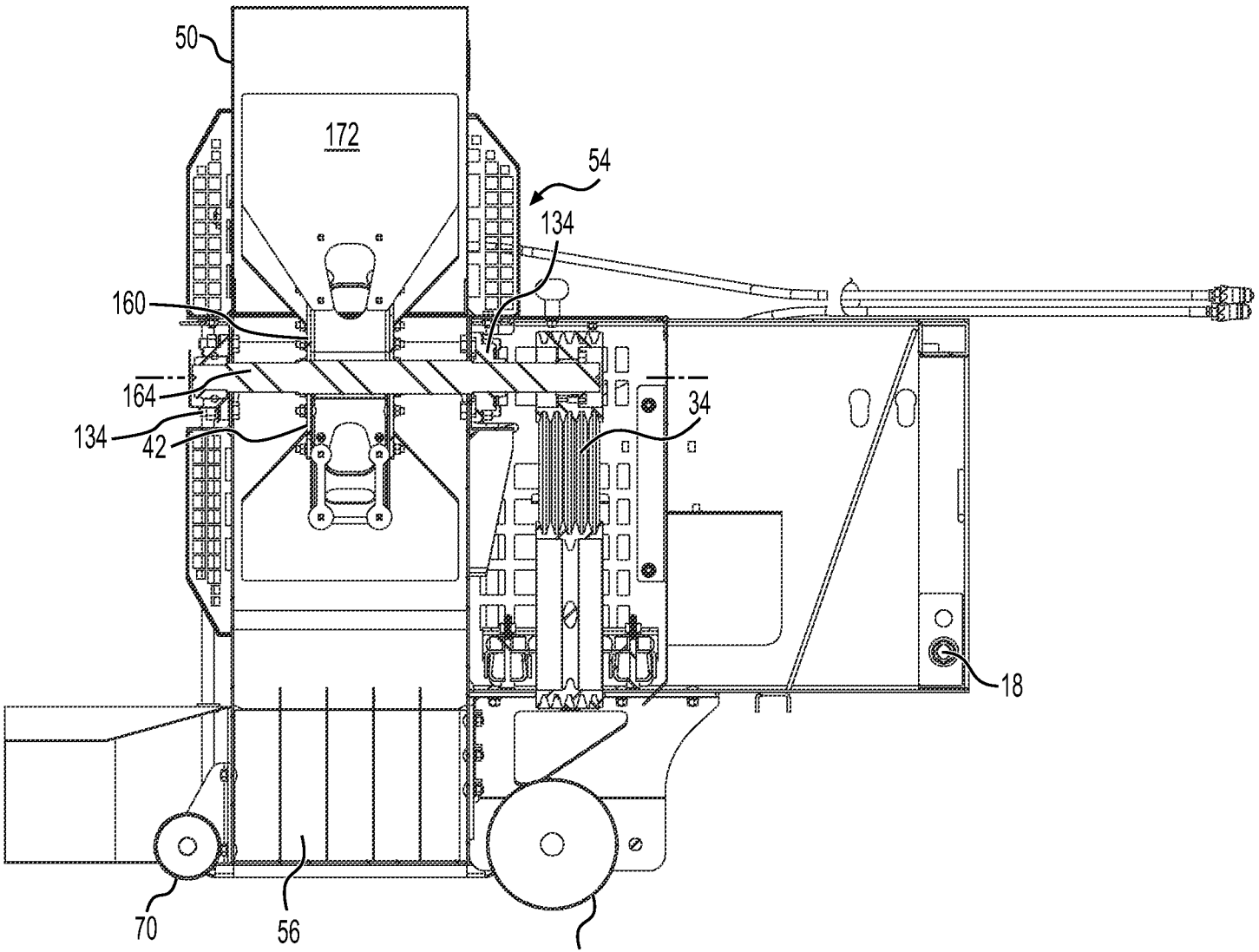
FIG. 4 is a right-side sectional elevation view of the exemplary blower apparatus of the exemplary snowblower of FIG. 1, in accordance with at least one embodiment thereof.

As best seen in FIG. 2, the impeller housing 52 is covering the impeller 42 for protection against possible injuries and is also acting as the volute 90 in which the rotating impeller 42 is rotating air therein thus creating air movement and creating vacuum. The vacuum is bringing air through the openings 54, mainly located in a proximal region 94 of the impeller 42, for air to be drawn and subjected to centrifugal forces toward a distal region 98 of the impeller 42. The impeller housing 52 is including an outside peripheral portion 102 that is progressively increasing in radius from a narrow region 106 to a wide region 110 where the flow of air 114 is stopped from rotating with the impeller 42 in the impeller housing 52 with an air flow direction member 118. As best seen in either FIG. 3, FIG. 4 of FIG. 5, the impeller 42 is supported by an impeller axle 122 that is supported by a pair of opposed bearings 126. The ratio-altering mechanism 30 is using an intermediate axle 130 supported by a pair of bearings 134 in addition to a belt tensioner 140 mounted to the frame 14 to bias tension in the belt 38 (in the present situation, a plurality of V-belts type 38) with a biasing mechanism 144 embodied as a spring mechanism in the illustrated embodiment.

Figure 6:
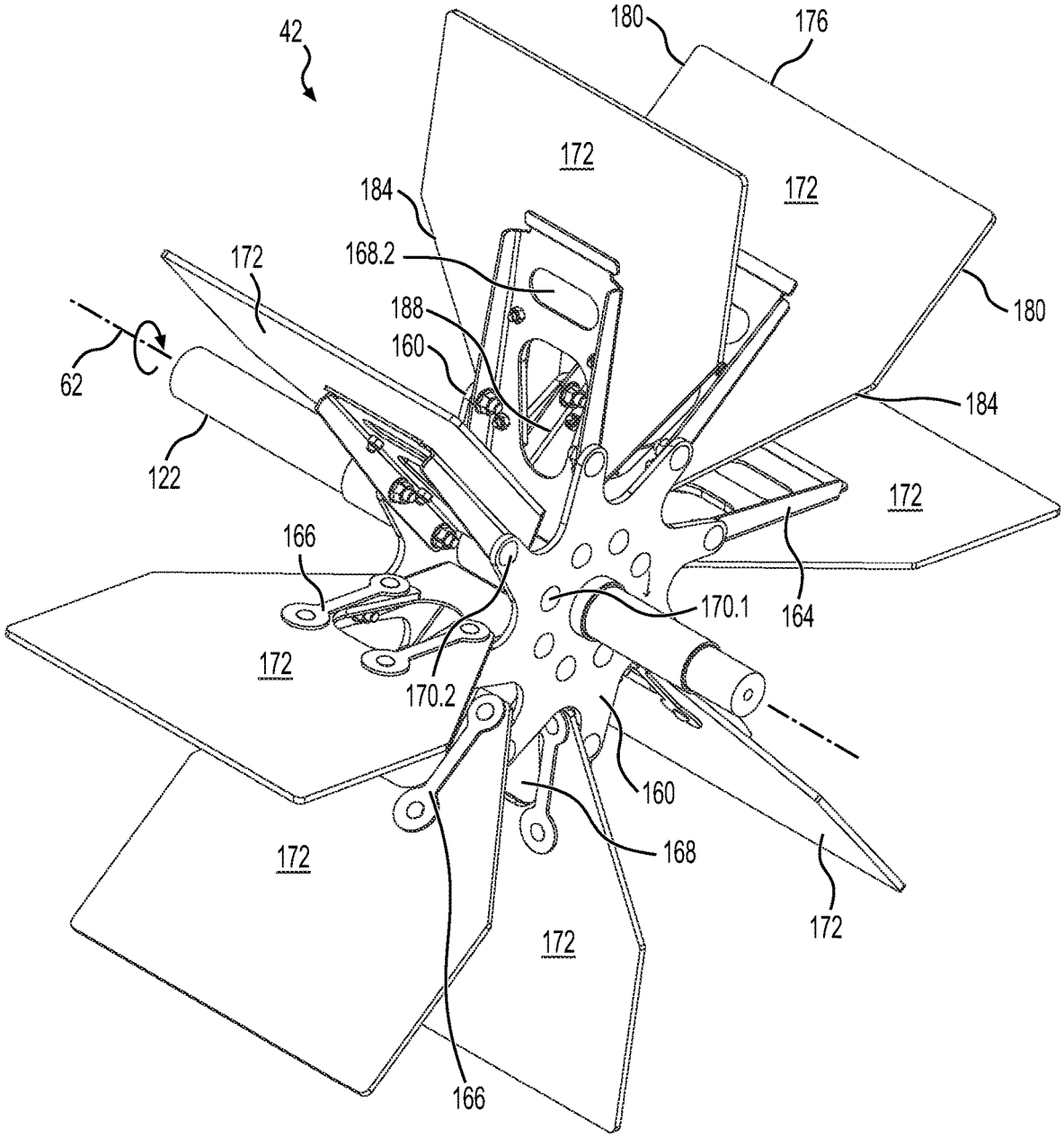
FIG. 6 is a rear-left perspective view of an impeller operatively assembled in the exemplary blower apparatus of FIG. 1, in accordance with at least one embodiment thereof.
Figure 7:
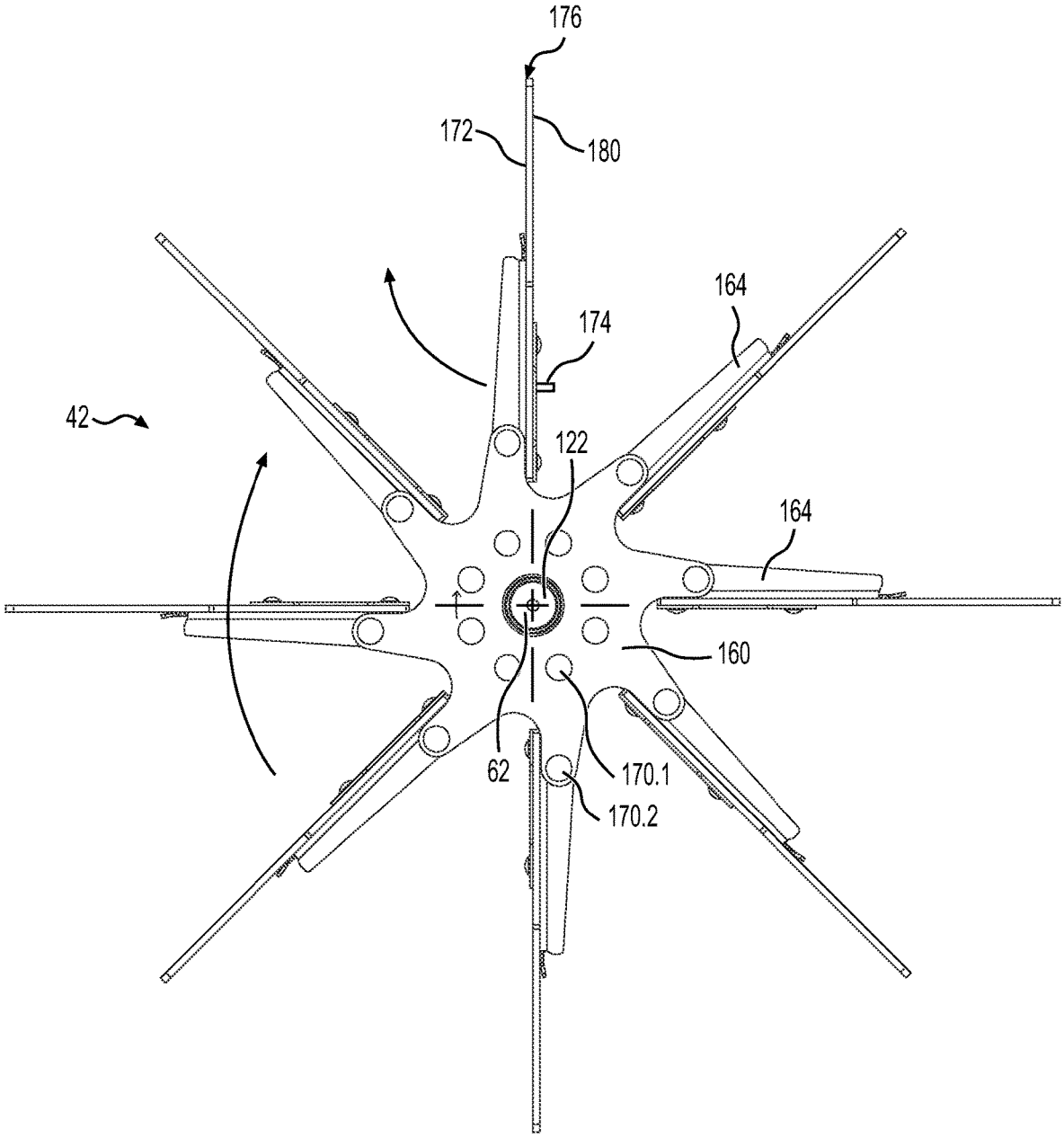
FIG. 7 is a rear elevation view of the impeller of FIG. 6, in accordance with at least one embodiment thereof.
Figure 8:
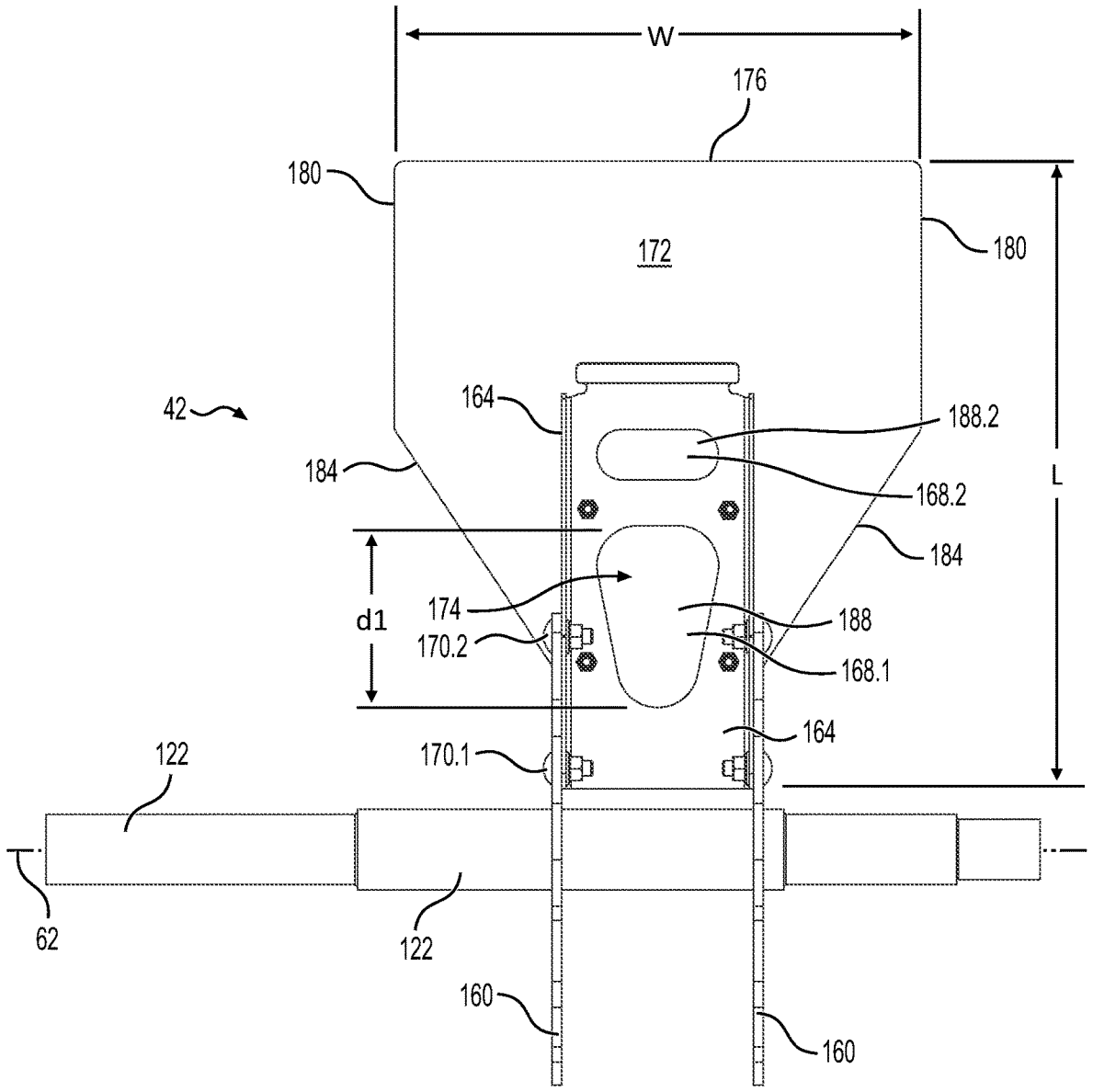
FIG. 8 is a left-side partial elevational view of the impeller of FIG. 6, in accordance with at least one embodiment thereof.

Moving now to FIG. 6, FIG. 7 and FIG. 8 depicting a magnified view of the impeller 42 in accordance with embodiments of the invention. The impeller 42 is assembled about the impeller axle 122 with a pair of flanges 160 that are radially extending from the axis 62 and axially distanced from each other for securing a plurality of radial supports 164. Each radial support 164 is secured to the flanges 160 with two securing elements 170.1 and 170.2. The radial supports 164 are configured with a plurality of openings 168.1, 168.2 therein as illustrated. Alternate configurations providing at least one opening in the radial supports 164, or a portion where there is a void of material, with corresponding openings of radial length d1 in the vanes 172 having an orthogonal length W and a radial length L, to allow air to pass therethrough 174 when the impeller 42 is rotating remain within the scope of the present invention without departing from the scope of this description. It can be appreciated that the openings 168 in the radial supports 164 and the vanes 172 are proximally disposed with respect to the impeller axis 62, leaving a distal portion of the vanes 172 without openings therein to efficiently propel air. Preferably, the radial length d1 of an opening 174 extends over at least 5% of the orthogonal length W of the vane 172 in which it takes place. Preferably, the radial length d1 of an opening 174 extends over at least 10% of the radial length L of the vane 172 in which it takes place.

Still in reference with to FIG. 6, FIG. 7 and FIG. 8, each radial support 164 is configured to secure thereto a vane 172 forming in this embodiment an array of eight (8) vanes 172 substantially equally distributed about the impeller axle 122—although a different number of vanes 172 remain contemplated by the present application to match power units of different power and blowing capacity. An even number of vanes 172 can be desirable in some embodiments while an odd number of vanes 172 can alternatively be desirable in some other embodiments. The vanes 172 are generally evenly distributed about the impeller axis 62 to ensure proper balancing of the assembly and prevent undesirable vibrations when the impeller 42 is rotating. The vanes 172 are secured between the radial supports 164 and an optional securing member 166 to increase the strength of the assembly. Each one of the vanes 172 is including a distal edge 176 connected to a pair of orthogonal lateral edges 180 proximally connected to a pair of angled portions 184 sized and designed for leaving a distance with adjacent walls of the impeller housing 52 facilitating air to be channeled from the openings 54 generally aligned with a proximal region of the impeller 42 around the impeller axle 122 to be distally propelled with centrifugal forces of the rotating impeller 42 out of the rear cover 50 through outlet 56.

For exemplary purposes, the distal edge 176 of the vane 172 can have an axial length of about 33 centimeters (13 inches) and the complete orthogonal length of the vane 172 including combined the lateral edges 180 length and the angled portion 184 length can illustratively be of about a little less than 33 centimeters (13 inches) to allow sufficient operational clearance for the rotating parts. Other dimensions remain within the scope of the invention based on different parameters like the drive engine power, the type of "dirt" to be blown, the speed of work and the size of the apparatus, to name a few. It can be appreciated that each vane 172 is provided with an opening 188 therein allowing air to pass through the vanes 172 to alleviate some of the restriction created by the rotating vanes 172 and increases the vacuum generated by the rotating impeller 42. The opening 188 is embodied as a single opening although a plurality of openings is contemplated in other alternate embodiments. It can also be appreciated that in embodiments thereof, the vane opening 174 is substantially matching the opening 168 of the corresponding radial support 164 to allow air to pass through the complete assembled structure. Other embodiments can use smaller openings 174 in the vanes 170 for adjusting the amount of air passing through each vane 170 without reworking the corresponding openings in the radial support 164 These openings toward the proximal radial region of the impeller 42 is thus improving the vacuum and blowing efficiency of the blower apparatus 10 that is translating in more air blown by the impeller for a same power input or, is providing the same vacuum and blowing efficiency with less power input.

Figure 9:
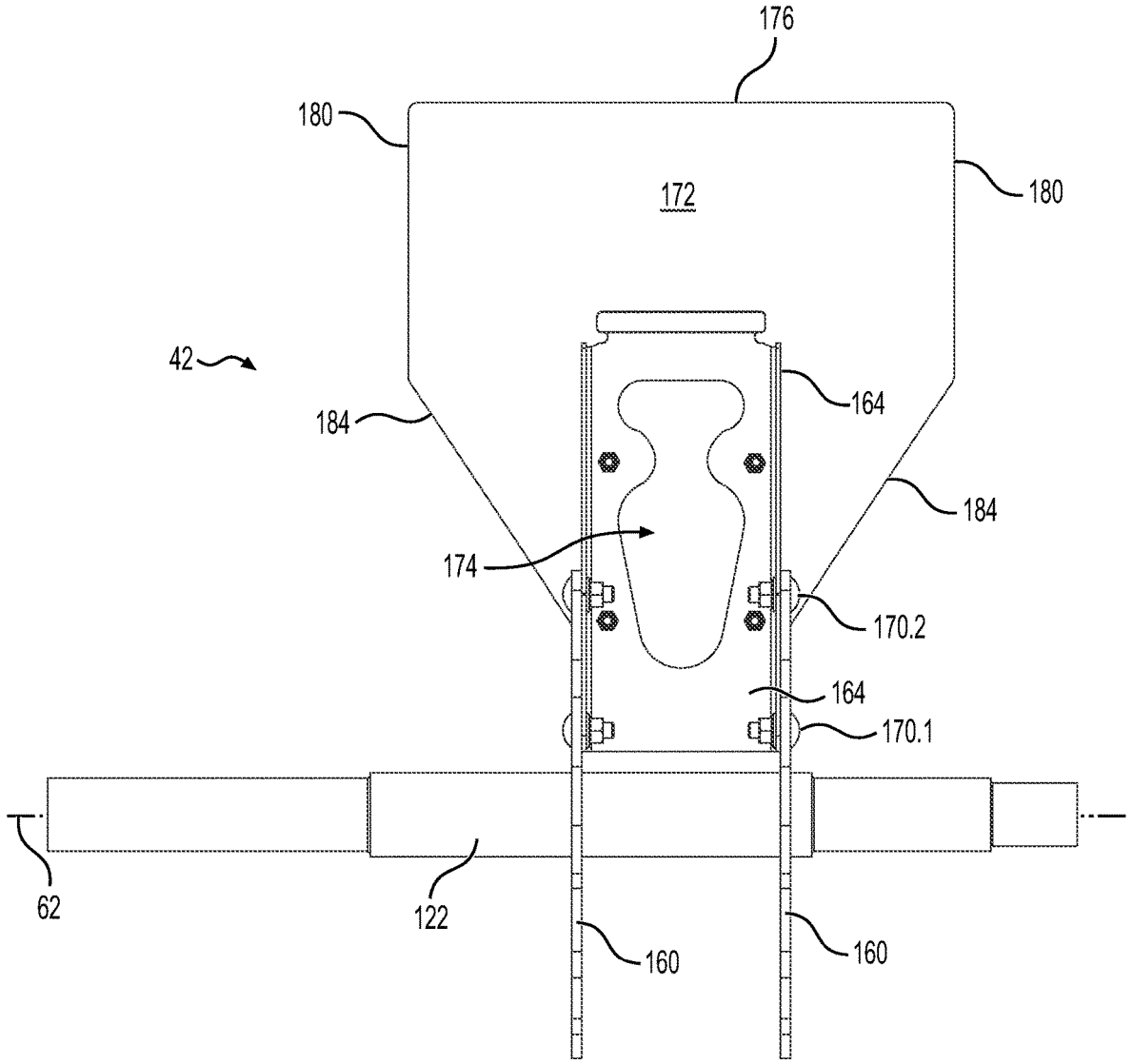
FIG. 9 is a left-side partial elevational view of an alternate impeller, in accordance with at least one embodiment thereof.
Figure 10:
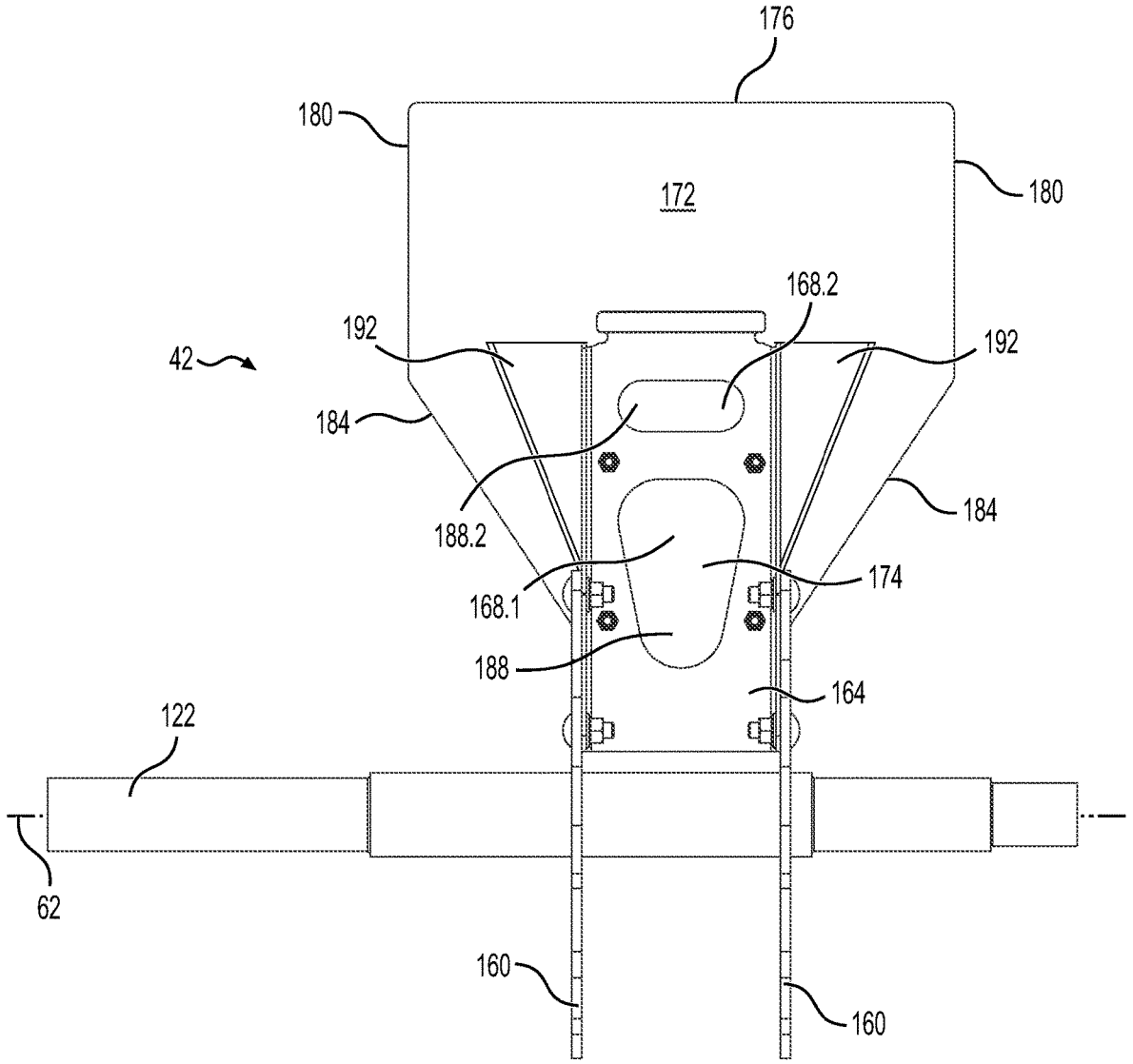
FIG. 10 is a left-side partial elevational view of an alternate impeller, in accordance with at least one embodiment thereof.

FIG. 9 is illustrating an alternate embodiment with an opening 174 including a different shape, like an "8" or hourglass shaped opening 174, radially extending from the impeller axle 122 for increased air transmission between angularly adjacent vanes 172. The radial support 164 is further axially extended with support extensions 192 in another embodiment to increase the rigidity of the impeller 42 assembly as illustrated in FIG. 10. Other variations of the radial support 164 remain within the scope of the present invention.

Figure 11:
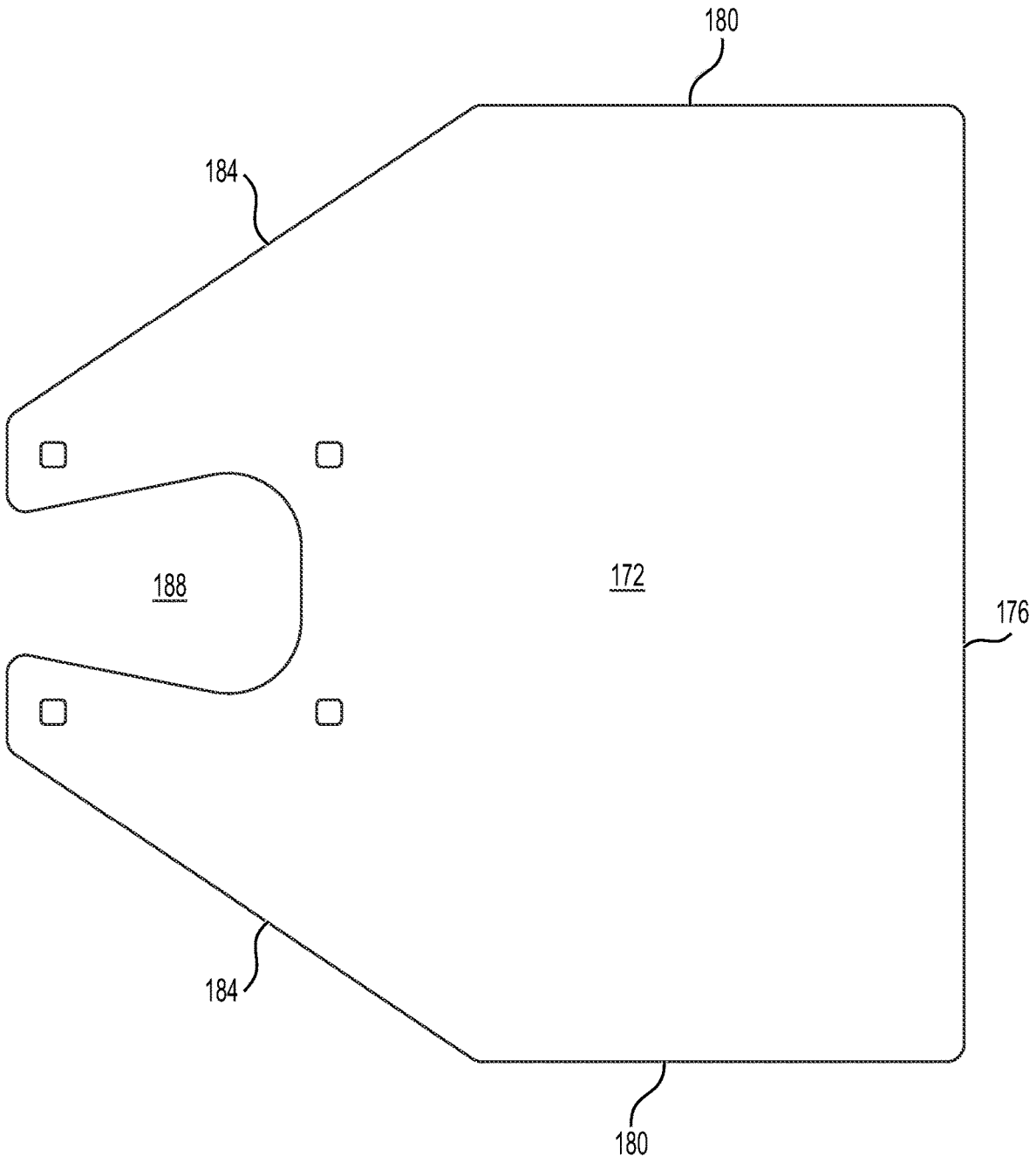
FIG. 11 is a top plan view of a vane, in accordance with at least one embodiment thereof.
Figure 12:
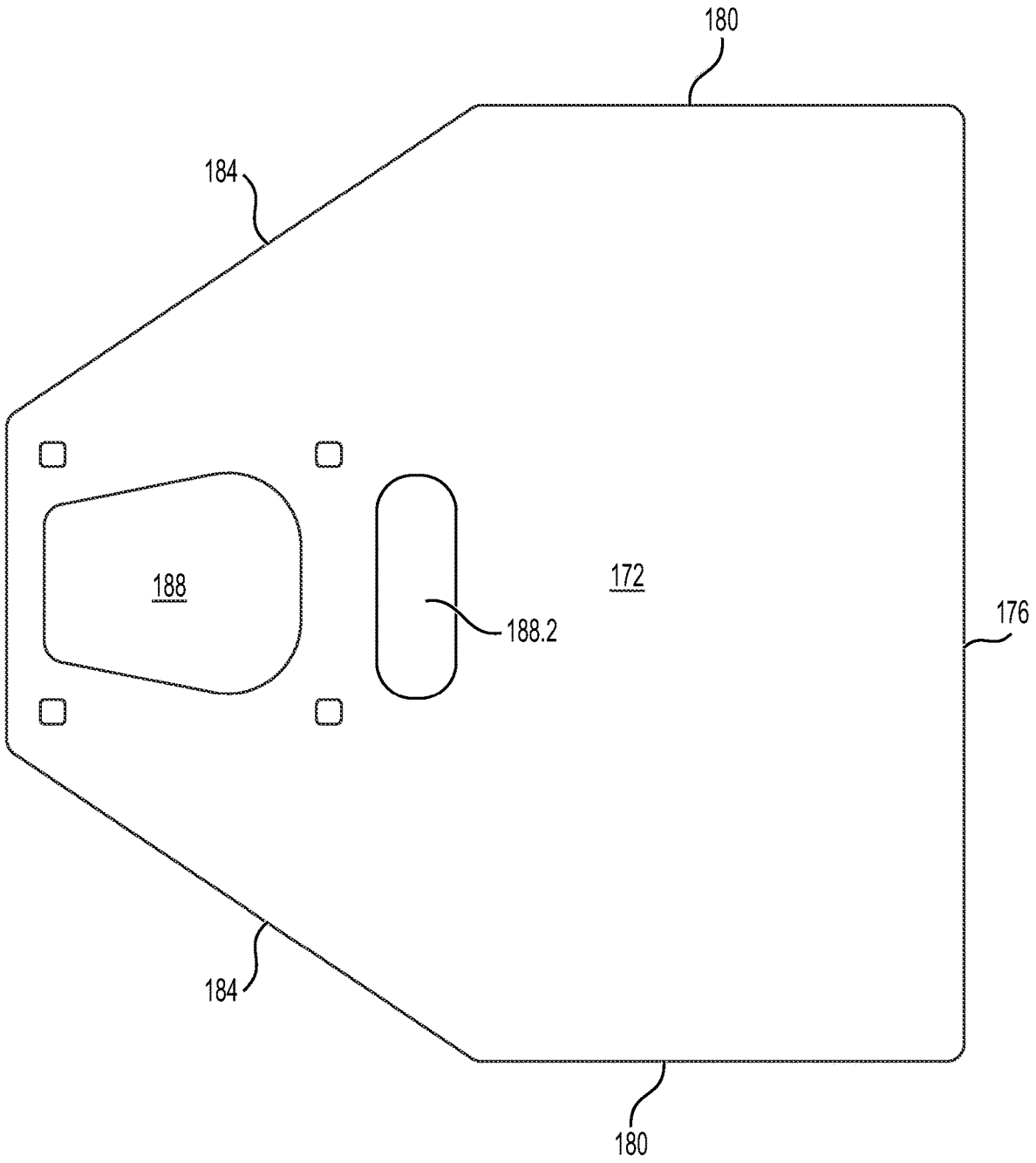
FIG. 12 is a top plan view of an alternate vane, in accordance with at least one embodiment thereof.
Figure 13:
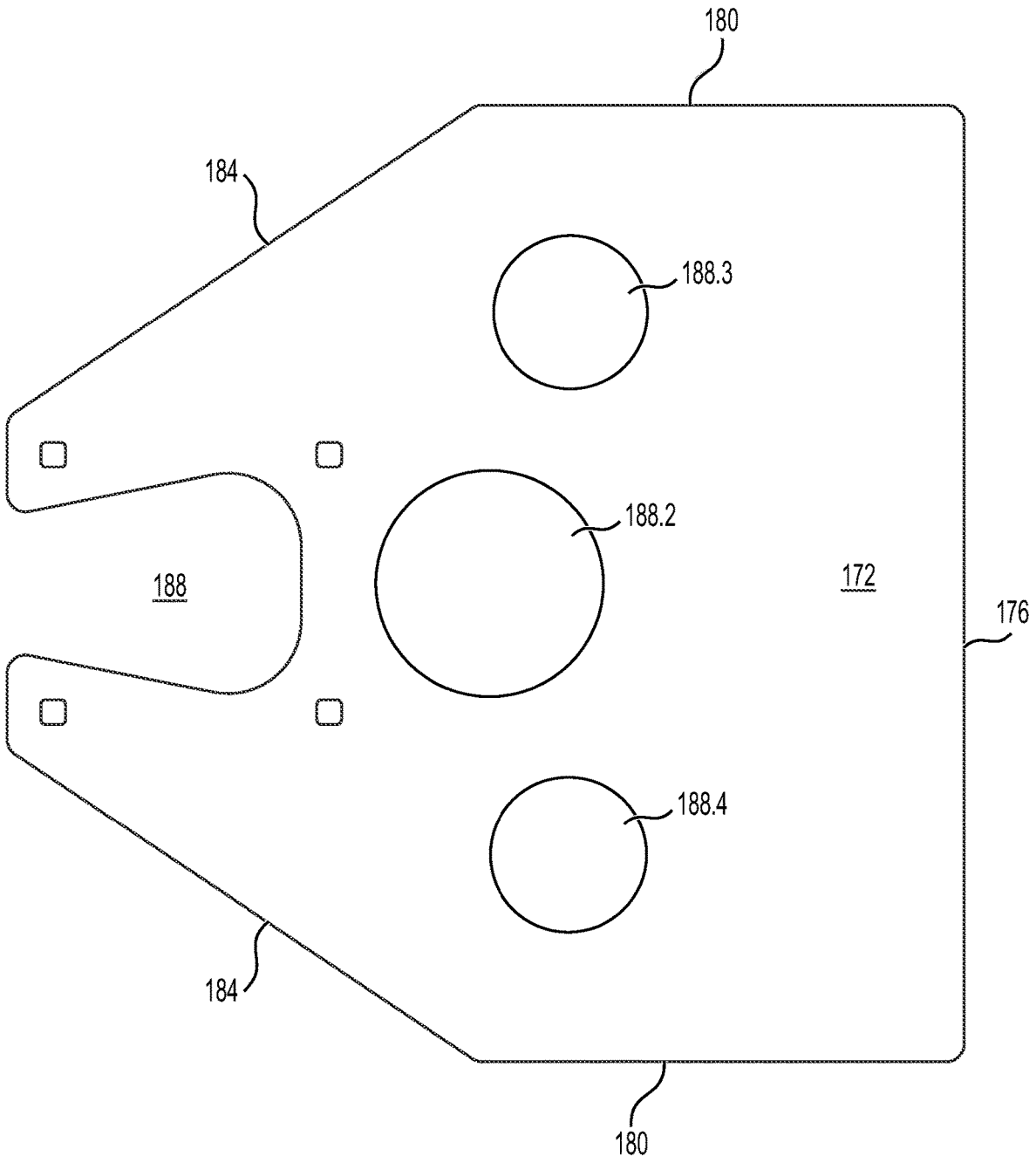
FIG. 13 is a top plan view of an alternate vane, in accordance with at least one embodiment thereof.

FIG. 11 is illustrating an isolated vane 172 from which it is possible to appreciate the opening 188 is embodied as a recessed portion, not a hole per se, to achieve the desired result to allow air to pass through the vane 172 when the vane 172 is rotating. The vane 172 of the illustrated embodiment is made with Alucobest™ aluminum composite panel that is light, rigid, resistant to corrosion with an exemplary thickness of about 3 millimeters with a plastic core laminated on both sides with a layer of aluminum of about 0.25 millimeters thick. Other material suitable for serving a similar purpose remain within the scope of this invention. Different patterns of openings 188 with a second opening 188.2, as show in FIG. 12 can be used to match the openings 168 of the radial support 164. Other configurations can be embodied to open more or less the vane 172 to modify the air flow across the vanes 172. One additional illustrative embodiment is illustrated in FIG. 13 depicting a vane 172 with three symmetrical round openings 188.2, 188.3 and 188.4 therein for further opening the vane 172 while maintaining strength integrity of the vane 172.

The description and the drawings that are presented above are meant to be illustrative of the present invention. They are not meant to be limiting of the scope of the present invention. Modifications to the embodiments described may be made without departing from the present invention, the scope of which is defined by the following claims:

What is claimed is:

1. A blowing apparatus comprising a body including an impeller comprising an impeller axle configured to rotate about an impeller axis, the impeller being equipped with a plurality of vanes configured to be mounted parallel to the impeller axis and to extend radially over an orthogonal length, each vane including an opening therein that is perpendicular to a rotation direction of the vane, with the opening configured to allow air to pass therethrough when the impeller is rotating in an impeller housing, wherein the opening extends radially over at least 5% of the orthogonal length of the vane.

2. The blowing apparatus of claim 1, the impeller further comprising a plurality of radial supports configured to radially secure the vanes to the impeller axis, the radial supports including a portion sized and designed to allow air to pass therethrough when the impeller is rotating in the impeller housing.

3. The blowing apparatus of claim 2, wherein at least some of the plurality of radial supports include at least one securing member for securing the vane thereon.

4. The blowing apparatus of claim 2, wherein at least some of the plurality of radial supports include at least one raised edge bordering an axial side of the portion sized and designed to allow air to pass therethrough when the impeller is rotating in the impeller housing.

5. The blowing apparatus of claim 2, wherein each of the radial supports and a vane assembly are sized and designed with an opening therein to allow air to pass therethrough when the impeller is rotating.

6. The blowing apparatus of claim 1, wherein the impeller housing includes at least one housing opening generally aligned with the impeller axis, the housing opening being configured to allow air inside the impeller housing in an axial and proximal region of the impeller.

7. The blowing apparatus of claim 1, wherein the impeller housing includes a volute configuration therein.

8. The blowing apparatus of claim 1, wherein each of the plurality of vanes is including a second opening therein to allow air to pass therethrough when the impeller is rotating.

9. An impeller comprising a body including an impeller comprising an impeller axle configured to rotate about an impeller axis, the impeller being equipped with a plurality of air-propelling elements mounted parallel to the impeller axis and extending over an axial length, each air-propelling element including an opening therein to allow air to pass therethrough when the impeller is rotating in an impeller housing, wherein the opening extends radially over at least 10% of the axial length of the vane.

10. The impeller of claim 9, the impeller further comprising a plurality of radial supports configured to radially secure the air-propelling elements to the impeller axis, the radial supports including a portion sized and designed to allow air to pass therethrough when the impeller is rotating in the impeller housing.

11. The impeller of claim 10, wherein at least some of the plurality of radial supports include at least one securing member for securing the air-propelling element thereon.

12. The impeller of claim 10, wherein at least some of the plurality of radial supports include at least one raised edge bordering an axial side of the portion sized and designed to allow air to pass therethrough when the impeller is rotating in the impeller housing.

13. The impeller of claim 10, wherein the impeller housing includes at least one opening generally aligned with the impeller axis to allow air inside the impeller housing in an axial and proximal region of the impeller.

14. The impeller of claim 10, wherein each of the radial supports and air-propelling element assembly is sized and designed with an opening therein to allow air to pass therethrough when the impeller is rotating.

15. The impeller of claim 9, wherein the impeller housing includes a volute configuration therein.

16. The impeller of claim 9, wherein each of the plurality of air-propelling elements is including an opening therein to allow air to pass therethrough when the impeller is rotating.

17. A blowing apparatus comprising a body including an impeller configured to rotate around an impeller axis, the impeller comprising:

a plurality of radial supports; and a plurality of vanes each having an axial length, each one of the vanes being mounted to one of the radial supports, wherein each one of the radial supports and the vane mounted thereto feature at least one of i) an opening and ii) a recess mounted in alignment with each other to form a common opening configured to allow air to pass therethrough when the impeller is rotating in an impeller housing, wherein the common opening extends radially over at least 10% of the axial length of the vane.

18. The blowing apparatus of claim 17, wherein configured to be mounted parallel to the impeller axis and to extend radially.

19. The blowing apparatus of claim 17, wherein the vanes have a substantially uniform thickness.

20. The blowing apparatus of claim 17, wherein at least one of the plurality of radial supports includes at least one raised portion extending at least partially about the common opening.

* * * * *